United States Patent [19]

Johnston et al.

[11] Patent Number: 4,520,520

[45] Date of Patent: Jun. 4, 1985

[54] MERCERIZATION PROCESS AND APPARATUS

[76] Inventors: Lawton L. Johnston, P.O. Box 104, Graniteville, S.C. 29827; Craig A. Brandon, 103 Crestwood Dr., Clemson, S.C. 29631

[21] Appl. No.: 462,909

[22] Filed: Feb. 1, 1983

[51] Int. Cl.[3] ..... D06B 7/08; D06B 23/20

[52] U.S. Cl. ..... 8/151; 8/125; 8/158; 68/9; 68/18 F

[58] Field of Search ..... 8/151, 158, 125; 68/9, 68/18 F; 210/652, 433.2

[56] References Cited

U.S. PATENT DOCUMENTS 1,980,498 11/1934 Nitsche ..... 8/151 X 4,200,526 4/1980 Johnson et al. ..... 210/652 X 4,270,914 6/1981 Dahl ..... 8/125

*Primary Examiner*—Philip R. Coe

*Attorney, Agent, or Firm*—Bailey & Hardaway

[57] ABSTRACT

In a process for mercerizing cellulosic cloth by treating the cloth with 3–10% caustic solution at the boil in a boilout stage, washing the cloth after treatment in the boilout stage and treating the washed cloth with 20–25% caustic in a mercerizer, an improvement comprises the steps of:

(a) collecting overflow from the boilout stage, contaminated with additives used in weaving or knitting the cloth;

(b) treating the contaminated overflow from the boilout stage by hyperfiltration to produce a recovered fraction of relatively pure caustic solution and a concentrate fraction containing additives used in weaving or knitting the cloth;

(c) washing the cloth after treatment in the boilout stage with the recovered fraction of relatively pure caustic from step (b).

19 Claims, 2 Drawing Figures

MERCERIZATION PROCESS AND APPARATUS

BACKGROUND OF THE INVENTION

This invention relates to a process for decontamination of caustic solution, used in the boilout section of a mercerizing facility for cellulosic fabrics, whereby thus-decontaminated caustic can be used in a rinsing bath disposed upstream of the point at which the cloth enters the mercerizer.

Cerini has disclosed, in U.S. Pat. No. 1,719,714, purification of caustic soda by osmotic principles.

Steele et al, in U.S. Pat. No. 2,558,064, have described the preparation of parchmentized paper dialysis membranes, particularly adapted for dialysis of sodium hydroxide solutions.

Nitsche, in U.S. Pat. No. 1,980,498, has described several techniques for reutilization of waste lye from mercerization. Concentration of the waste lye by evaporation is among the contemplated alternatives, but is regarded as being economically unfeasible.

Carr et al, U.S. Pat. No. 2,980,501, purify spent mercerization caustic by treatment with chlorine or a hypochlorite.

Hyperfiltration, ultrafiltration or reverse osmosis treatment of various effluents have been proposed, for example, in the following U.S. Pat. Nos. 3,528,901, Wallace et al: 3,537,988, Marcinkowsky et al: 3,778,366, Kraus: 4,156,621, Andrews et al: 4,165,288, Teed et al.

Hermes has recited, in U.S. Pat. No. 4,055,971, use of filters in a closed-cycle apparatus for continuous, waterless dyeing of textile and plastic materials.

In the context of solvent recovery in commercial washing or dry cleaning of clothing, both Victor (U.S. Pat. No. 3,728,074) and Klein et al. (U.S. Pat. No. 3,841,116) have proposed the use of filters or solid bodies of adsorbent materials to remove contaminants from the solvents.

It has been proposed by Lawrence, in U.S. Pat. No. 4,074,969, to recover and reuse liquid ammonia, used for the processing of fabrics. The reference proposes feeding process effluent to a desuperheating vessel, in which the effluent is brought into direct contact with a body of low temperature liquid ammonia. The condensate formed in the desuperheater is recycled to the process.

Gresens et al have proposed, in U.S. Pat. No. 4,231,165, a process for heattreating fabric webs, wherein waste gas from the treatment unit is treated to remove condensible constituents therefrom and, ultimately, recycled to the treatment unit.

Klare, in U.S. Pat. No. 3,889,390, has disclosed a continuous process for reclamation of softening agent, used to treat regenerated cellulose film. Recovery is accomplished by absorption of the softening agent from an exhaust air stream.

It will be apparent that, although a variety of techniques have been put forth for the treatment of waste from mercerizing or other textile-treating installations, none of the presently available techniques employed in treating caustic wastes from a mercerizing installation is entirely satisfactory in view of economic criteria, which favor processes characterized by low loss of materials and heat, and environmental considerations, which favor processes discharging small volumes of relatively harmless effluents.

OBJECT OF THE INVENTION

It is an object of the invention to provide an improved method and apparatus for mercerizing cotton cloth, wherein contaminated caustic solution, used in the boilout stage of the process, is purified by hyperfiltration and recycled to a downstream counterflow washer. This process requires small amounts of make-up chemicals, conserves heat used in the process and results in a relatively unobjectionable effluent for discharge to the environment.

SUMMARY OF THE INVENTION

In one aspect this invention relates, in a process for mercerizing of celulosic cloth comprising treating the cloth with 3–10% caustic at the boil in a boilout stage, washing the cloth after treatment in the boilout stage and treating the washed cloth with 20–25% caustic in a mercerizer, to the improvement comprising the steps of:

(a) collecting overflow from the boilout stage, contaminated with additives used in weaving or knitting the cloth;

(b) treating the contaminated overflow from the boilout stage by hyperfiltration to produce a recovered fraction of relatively pure caustic solution and a concentrate fraction containing additives used in weaving or knitting the cloth and (c) washing the cloth after treatment in the boilout stage with the recovered fraction of relatively pure caustic from step (b).

In another aspect, this invention relates, in an apparatus for mercerizing cellulosic cloth comprising boilout means for treating the cloth the 3–10% caustic solution, means for washing the cloth downstream of the boilout means and mercerizer means for treating the washed cloth with 20–25% caustic solution, to the improvement wherein the boilout means is provided for means for collection of overflow liquor, contaminated with additives from weaving or knitting; the overflow collection means is provided with hyperfiltration means for treating the overflow liquor to produce a recovered fraction of relatively pure caustic solution and a concentrate fraction, containing additives used in weaving or knitting; and the apparatus is provided with means for recycling the recovered fraction of relatively pure caustic solution to the washing means.

DETAILED DESCRIPTION

Mercerization is a process in which textiles of cellulosic origin are passed through a strong solution of aqueous caustic. The goods can be stretched after treatment with the caustic. Prior art processes employed about 50% caustic solution, in which up to 5–10% by weight of dissolved, colloidal and suspended impurities, including hemicelluloses, debris, pectins, sizing, waxes and oils. Attempted concentration of the depleted caustic solution resulted in a dark syrupy material, which was not acceptable for recycle to the mercerizer without further purification.

Both filtration and dialysis have been investigated as methods for recovering caustic solutions of quality and strength appropriate for recycle to the mercerizer. Filtration is unsatisfactory because colloidal material is not completely removed from the caustic solution, which eventually becomes too viscous to be useable. In addition, colloidal contaminants plug the filters, which must be backwashed more frequently than is desirable. Dialysis accomplishes separation of the colloidal contaminants from the caustic solution, but is accompanied by dilution of the caustic, which must accordingly be reconcentrated before recycle to the process.

Caustic, as used in mercerizing terminology, commonly means sodium hydroxide. However, it will be understood that the process and apparatus of this invention can also be used for mercerizing cellulosic cloth with potassium hydroxide or mixtures of potassium and sodium hydroxides.

Figure 1:
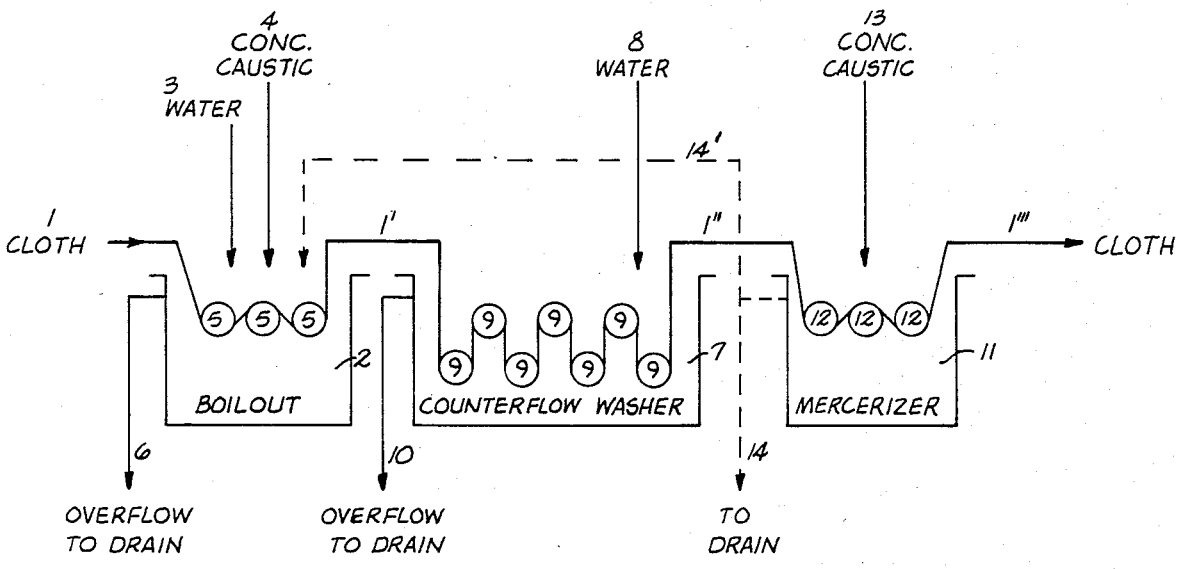
Fig. 1 PRIOR ART
In FIG. 1 is shown a conventional plant layout for mercerization of cotton fabrics.

In a typical prior art mercerizing plant, shown in FIG. 1, cloth of cellulosic fibers (1) is entered into the boilout tank (2), which contains 3–10% caustic solution. The cloth, which may be knitted or woven, is heated in the tank at a temperature near the boil (90°–105° C.). Typically, wet cloth entering the system will introduce clean water into the boilout tank at a rate of about 5 gallons/min.

Materials fed to the boilout tank include water and concentrated caustic solution, shown in the drawing as being added to the top of the tank at (3) and (4), respectively. It will be understood that the mode of adding water and caustic solution is not critical. It is convenient, but not essential, to employ make-up caustic of about 40% solids.

The cloth in the boilout tank progresses over a series of rollers (5), so that the caustic solution in the tank contacts all portions of the cloth. The overflow leaving the boilout section is diluted, because cloth (1), fed into this section, carries with it large quantities of water, whereas cloth leaving the boilout section (1') takes out a corresponding amount of caustic solution. Therefore, addition of caustic is necessary to maintain the desired caustic concentration and provide an overflow volume for the control of contaminant level. In addition, there will generally be loss of water by evaporation, which loss is of the order of 1–5 gallons/min. Provision is made for removal of spent solution by an overflow pipe (6). Before stringent waste water standards became the norm, the overflow pipe discharged the spent solution to the sewer or a nearby pond or stream. Aside from the ecological implications, this practice was wasteful and meant that large amounts of make-up water and caustic solution were required to replenish the spent caustic. In addition, direct discharge of the overflow meant the loss of heat energy therein, which was uneconomical and presented another insult to the environment.

Cloth (1') leaving the boilout stage is passed into a counterflow washer (7) and washed with water (8), fed into the washer. The cloth is passed over a series of rollers (9) in the washer. The overflow (10) from the counterflow washer is discharged to the drain.

The washed cloth (1'') enters the mercerizer (11) and is passed over rollers (12) in a caustic solution, containing 20–25% by weight of caustic. The temperature and residence time in the mercerizer are those customary in the art. Feed to the mercerizer includes concentrated caustic solution (13). Conveniently, 40% aqueous caustic will be used. Owing to the amounts of liquid entrained in the cloth entering the mercerizer, addition of water is generally unnecessary. The amount of entrained liquid will be of the order of 5 gallons/min. Cloth (1''') leaving the mercerizer can be washed with water before entry into a dye bath. Effluent from the mercerizer can be discharged to the drain (14) or returned to the boilout tank by the line designated (14').

Figure 2:
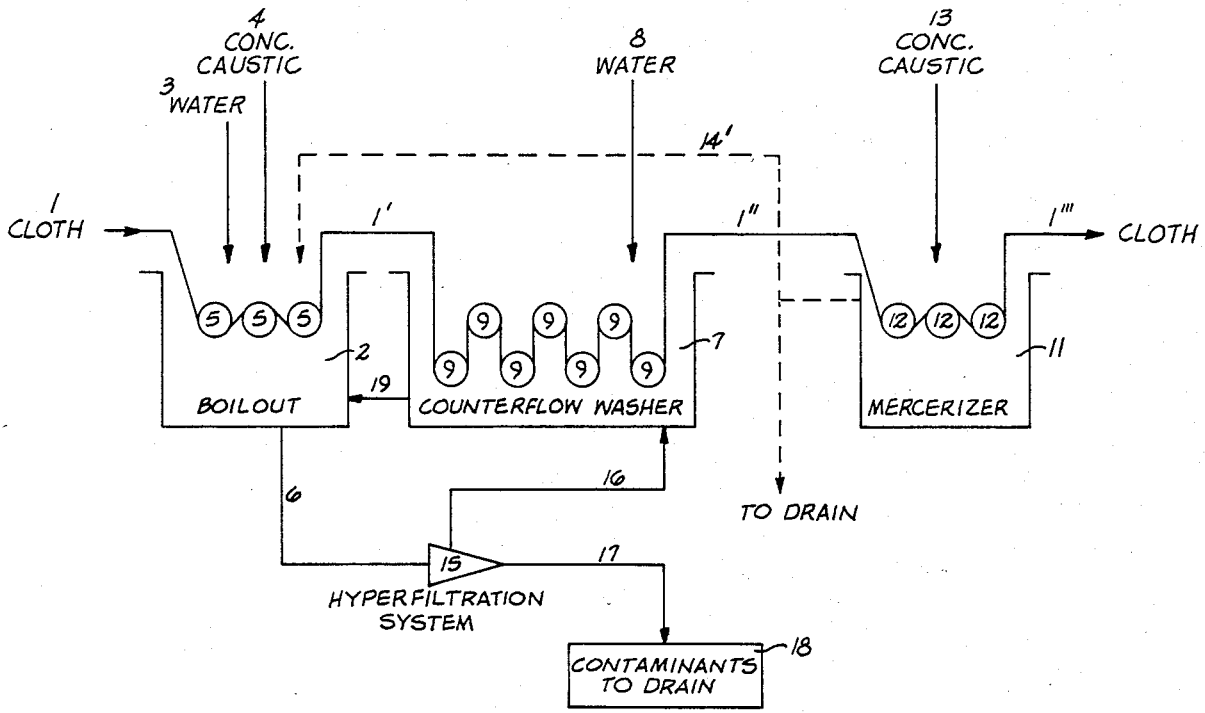
In FIG. 2 is given a schematic representation of the process and plant layout in accordance with this invention.

In the process and apparatus of this invention, as shown in FIG. 2, overflow (6) from the boilout means (2) is collected in a collecting means and fed to the hyperfiltration means (15). The effluent from the hyperfiltration means comprises a fraction of recovered relatively pure caustic solution (16), which is recycled to the washer, and a concentrate fraction (17), containing additives used in knitting or weaving. This fraction is conveniently withdrawn from the system by a drain (18).

It is preferred that the recovered relatively pure dilute caustic solution be fed to the washer so as to provide for countercurrent flow of the cloth in the washer with respect to the recovered caustic solution. It is also preferred that the caustic solution be returned to the system without any external cooling, so as to minimize loss of heat energy. Since the caustic solution in the boilout means has been diluted by water, carried along with the cloth entering the system, it is preferred to concentrate the caustic solution recovered in the hyperfiltration step to about 3–10% by weight.

It is possible and is preferred to return the wash liquor (19) from the washer (7) to the boilout stage.

Hyperfiltration, as recited by Kiser et al., in U.S. Pat. No. 4,250,029, is also known as reverse osmosis (RO). Electrodialysis (ED) and ultrafiltration (UF) are other techniques used for the deionization of liquids, especially of water. Osmosis is the passage of liquids or gases through membranes, so as to separate solutions of different degrees of concentration by diffusion from a solution, in which they are more concentrated, to solutions in which they are less concentrated. This separation assumes that the membrane employed is permeable to the solutions involved. Osmotic pressure is the pressure which develops during separation of pure solvent from a solution through a semi-permeable membrane, which allows only solvent to pass through it. Osmotic pressure is accordingly the pressure which must be applied to the solution, in order to prevent its passage through the semipermeable membrane. Reverse osmosis will occur when pressure, above that of the osmotic pressure, is applied to the more concentrated solution to cause solute of the more concentrated solution to pass through the membrane to the less concentrated solution. Of course, solutes or other materials in the more concentrated solution would not pass through a membrane, which is impermeable to such materials.

The lines between reverse osmosis, hyperfiltration and ultrafiltration are not too well defined. However, ultrafiltration and hyperfiltration are considered as reverse osmosis techniques or devices, using semi-permeable membranes as molecular filters. The filters are the separating agency and pressure the driving force for the process. In either of ultrafiltration or hyperfiltration, feed solution enters the membrane unit, which usually consists of a substrate tube and a membrane formed thereon. Water and certain solutes pass through the membrane under an applied hydrostatic pressure. Solutes larger in size than the pore diameter of the membrane being employed are retained and concentrated. The pore structure of the membrane thus functions as a molecular filter, which permits passage of some of the smaller solute entities, but retains larger solutes. However, unlike conventional filters, the pore structure of these molecular filters does not become plugged, because unacceptable solutes are rejected at the surface of the filter and do not penetrate into its interior.

Membranes used in these processes include both organic and inorganic polymers, ceramics, glass frits, graphite and porous metals. The membranes are chosen so as to have very small openings or pores, which reject a significant portion of molecules or ions, larger than the selected cut-off size. Other membranes, used in these techniques, have ion-exchange properties. These membranes are "charged" and thereby repel ions of a selected charge and prevent their passage through the membrane. See Kiser et al. for a discussion of appropriate membrane compositions or structures.

Teed et al., supra, specifically disclose the use of dynamic membranes, formed on the surface of a porous substrate. Marcinkowsky et al., supra, is of similar interest. The teachings of these references are herein incorporated by reference.

Typical of the reverse osmosis modules which can be employed in the practice of this invention is that disclosed by Manjikian, U.S. Pat. No. 3,821,108, herein incorporated by reference.

Another representative hyperfiltration apparatus which can be employed in the practice of this invention is that of Gaddis et al., as recited in U.S. Pat. No. 4,200,533, herein incorporated by reference.

Hyperfiltration units which may be employed are further described in an information package entitled "Single Pass System," Carre, Inc. Seneca, S.C., 29678, as follows for the separation of a test solution of 100 mg/l of $NaNO_3$ in water:

| | Ultrafiltration ZOSS | Hyperfiltration ZOPA |
|---|---|---|
| flow geometry | tubular | tubular |
| membrane support | stainless steel (316 I) | stainless steel (316 I) |
| membrane material | ZrO | ZrO—PAA |
| method of replacement | in place chemical solution | in place chemical solution |
| prefiltration requirement | 40 mesh screen | 40 mesh screen |
| pressure limitation | >1000 psi | >1000 psi |
| temperature limitation | above 100° C. | above 100° C. |
| pH range | 2–13 | 4–10 |
| permeability | | |
| 100° F. | 0.1–0.4 | 0.05–0.07 |
| 200° F. | 0.4–1.2 | 0.2–0.3 |
| salt rejection | 5–20% | 80–90% |

ZOSS membrane at 1000 psig at 100° F.

$$\text{flux} = 0.025 \times 1000 = 250 \text{ gallons/day/ft}^2$$

ZOPA membrane at 1000 psig at 200° F.

$$\text{flux} = 0.025 \times 1000 = 250 \text{ gallons/day/ft}^2$$

Preferably the hyperfiltration membranes will be of ZrO or of ZrO-PAA (polyacrylic acid).

The hyperfiltration unit will be operated at a pressure above 1000 psi to provide a reasonable separation rate.

Relatively pure caustic solution, as recovered by hyperfiltration in accordance with the practice of this invention, means a solution containing at most 20% by weight of gums, waxes or other entrained impurities originally present. In practice, the recovered and recycled solutions can contain as low as 0.1–5% by weight of impurities originally present, depending on the membrane selected and the pressure applied.

DESCRIPTION OF MOST PREFERRED EMBODIMENTS

A most preferred process is that wherein the caustic is sodium hydroxide, the cloth is washed in counterflow fashion with the recovered fraction of relatively pure caustic and the thus-recovered fraction is circulated to the washing step without cooling, the recovered fraction of caustic is concentrated by hyperfiltration to contain 3–10% by weight of caustic and wherein the hyperfiltration/ultrafiltration membrane is ZrO or ZrO-PAA.

A most preferred apparatus is that wherein the means for recycling the recovered fraction of relatively pure caustic solution feeds the washing means to afford flow of the recovered fraction upstream through the washing means toward the boilout means and wherein the hyperfiltration/ultrafiltration membrane is ZrO or ZrO-PAA.

Without further elaboration, it is believed that one skilled in the art can, using the preceding description, utilize the present invention to its fullest extent. The following preferred specific embodiments are, therefore, to be construed as merely illustrative and not limitative of the remainder of the disclosure in any way whatsoever. In the following examples, temperatures are set forth uncorrected in degrees Celsius. Unless otherwise indicated, all parts and percentages are by weight.

EXAMPLE 1

Wet cloth, carrying 5 gallons/min of clean water, is passed into a boilout tank containing 3–10% sodium hydroxide solution. The evaporative loss of water in the tank is 1–5 gallons/min. Caustic solution (40%) is fed to the tank to maintain caustic concentration at the desired level. Effluent from the boilout tank (22 gallons/min) is passed into a hyperfiltration system (ultrafiltration ZOSS), in which separation is carried out. Clean 3–10% caustic solution is returned to the counterflow washer at a rate of 20 gallons/min and contaminated caustic (3–10%) caustic is removed to the external drain at a rate of 2 gallons/min.

Treatment in the counterflow washer and in the mercerizer is as in FIG. 2, wherein 5 gallons/min of solution are carried with the cloth from the counterflow washer to the mercerizer.

It is apparent that use of the ultrafiltration system permits recycling of more than 90% of the caustic solution to the system.

EXAMPLE 2

In a similar fashion, recovery of caustic solution is done using ZOPA hyperfiltration means. The results are generally as in Example 1.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. In a process for mercerizing of cellulosic cloth comprising treating the cloth with 3–10% caustic at the boil in a boilout stage, washing the cloth after treatment in the boilout stage and treating the washed cloth with 20–25% caustic in a mercerizer, the improvement comprising the steps of:

(a) collecting overflow from the boilout stage, contaminated with additives used in weaving and knitting the cloth;

(b) treating the contaminated overflow from the boilout stage by prefiltration to remove solid material and treating a resulting filtrate by hyperfiltration to produce a recovered fraction of relatively pure caustic solution and a concentrate fraction containing additives used in weaving or knitting the cloth;

(c) washing the cloth after treatment in the boilout stage with the recovered fraction of relatively pure caustic from step (b) and (d) withdrawing said concentrate fraction containing additives used in weaving or knitting the cloth from the system.

2. The process of claim 1, wherein the cloth is washed in counterflow fashion with the recovered fraction of relatively pure caustic and the thus-recovered fraction is circulated to the washing step without cooling.

3. The process of claim 1, wherein the recovered fraction is concentrated by hyperfiltration to contain 3–10% by weight of caustic.

4. The process of claim 1, wherein hyperfiltration is carried out using a membrane of ZrO or ZrO-PAA.

5. The process of claim 4, wherein the membrane is ZrO.

6. The process of claim 4, wherein the membrane is ZrO-PAA.

7. The procsss of claim 1, wherein the caustic is sodium hydroxide.

8. The process of claim 1, wherein the cloth is washed in counterflow fashion with the recovered fraction of relatively pure caustic and the thus-recovered fraction is circulated to the washing step without cooling; the recovered fraction is concentrated by hyperfiltration to contain 3–10% by weight of caustic and wherein hyperfiltration is carried out using a membrane of ZrO.

9. The process of claim 1, wherein the cloth is washed in counterflow fashion with the recovered fraction of relatively pure caustic and the thus-recovered fraction is circulated to the washing step without cooling; the recovered fraction is concentrated by hyperfiltration to contain 3–10% by weight of caustic and wherein hyperfiltration is carried out using a membrane of ZrO-PAA.

10. The process of claim 8, wherein the caustic is sodium hydroxide.

11. The process of claim 9, wherein the caustic is sodium hydroxide.

12. In an apparatus for mercerizing cellulosic cloth comprising boilout means for treating the cloth with 3–10% caustic solution, means for washing the cloth downstream of the boilout means and mercerizer means for treating the washed cloth with 20–25% caustic solution, the improvement wherein the boilout means is provided with means for collection of overflow liquor, contaminated with additives from weaving or knitting; the overflow collection mens is provided with a hyperfiltration means, downstream from a perfilter means for removing solid materials from the overflow liquor, for treating the resulting prefiltered overflow liquor to produce a recovered fraction of relatively pure caustic solution and a concentrate fraction, containing additives used in weaving or knitting; and the apparatus is provided with means for recycling the recovered fraction of relatively pure caustic solution to the washing means; and the apparatus is further provided with means for withdrawing said concentrate fraction, containing additives used in weaving and knitting.

13. The apparatus of claim 12, wherein the means for recycling the recovered fraction of relatively pure caustic solution feeds the washing means to afford flow of the recovered fraction upstream through the washing means toward the boilout means.

14. The apparatus of claim 12, further provided with means for discharging the concentrate fraction from the apparatus.

15. The apparatus of claim 12, wherein the hyperfiltration means includes a membrane of ZrO or ZrO-PAA.

16. The apparatus of claim 12, wherein the hyperfiltration means includes a membrane of ZrO.

17. The apparatus of claim 12, wherein the hyperfiltration means includes a membrane of ZrO-PAA.

18. The apparatus of claim 12, wherein the means for recycling the recovered fraction of relatively pure caustic solution feeds the washing means to afford flow of the recovered fraction upstream through the washing means toward the boilout means and wherein the hyperfiltration means includes a membrane of ZrO.

19. The apparatus of claim 12, wherein the means for recycling the recovered fraction of relatively pure caustic solution feeds the washing means to afford flow of the recovered fraction upstream through the washing means toward the boilout means and wherein the hyperfiltration means includes a membrane of ZrO-PAA.

* * * * *